United States Patent [19]

Harrison

[11] Patent Number: 5,011,710

[45] Date of Patent: Apr. 30, 1991

[54] BRIDGE MAINTENANCE METHOD AND EQUIPMENT

[76] Inventor: John F. Harrison, 2579 Prairie Ave., Holland, Mich. 49424

[21] Appl. No.: 269,470

[22] Filed: Nov. 10, 1988

[51] Int. Cl.[5] ..... E04G 1/18; E04G 1/00; B24C 9/00

[52] U.S. Cl. ..... 427/142; 427/140; 427/290; 427/292; 427/327; 427/421; 51/424; 51/426; 182/129; 182/142; 182/150

[58] Field of Search ..... 427/309, 327, 290, 421, 427/140, 142, 292; 51/424, 426; 182/142, 145, 150, 129

[56] References Cited

U.S. PATENT DOCUMENTS

| | | | |
|---|---|---|---|
| 3,076,522 | 2/1963 | Goodell | 182/150 |
| 3,394,776 | 7/1968 | Abrams | 182/150 |
| 3,765,923 | 10/1973 | Bender-Christensen | 427/290 |
| 4,351,863 | 9/1982 | Roesner | 427/421 |
| 4,429,764 | 7/1984 | Park | 182/129 |
| 4,649,672 | 3/1987 | Thomann | 51/426 |
| 4,660,680 | 4/1987 | Potin | 182/150 |
| 4,848,516 | 7/1989 | Nakai et al. | 182/150 |
| 4,852,687 | 8/1989 | Hittler | 182/129 |
| 4,854,419 | 8/1989 | Lyras et al. | 182/150 |

*Primary Examiner*—Norman Morgenstern
*Assistant Examiner*—Margaret Bueker
*Attorney, Agent, or Firm*—Waters & Morse

[57] ABSTRACT

Surfaces of a structure are treated from a walkway within an enclosure suspended from the structure. The enclosure has a downwardly-converging cross section terminating in a vacuum conveyor for collecting and removing particles accumulating from the blasting process. The enclosure is preferably provided in modules. The vacuum conveyor removes the particulate material for transfer to conventional separating and re-cycling equipment. the enclosure and walkway are moveably suspended from transverse guideways secured to the structure.

7 Claims, 17 Drawing Sheets

BRIDGE MAINTENANCE METHOD AND EQUIPMENT

BACKGROUND OF THE INVENTION

The maintenance of steel bridges centers in preventing or inhibiting corrosion, which becomes a particularly severe problem in areas where salt is used to stop the formation of ice on the roadway. If left unchecked, the corrosion can eventually compromise the structure to the point that it can no longer carry its designed load. Corrosion is dealt with by the use of special paints, some of these (particularly the older ones) having a lead base. The effective life of a paint job depends on the nature of the paint, and the manner of its application, including the preliminary surface preparation. Some presently available paints, properly applied, can be expected to last for 20 years or more. Lower quality of materials and work will shorten the life expectancy considerably.

Maintenance procedures normally involve particle blasting the surfaces of the structure to remove the old paint, and condition the surfaces to receive the new coatings. This is followed by spraying on several coats of various materials in sequence. Both steps produce serious pollution problems. The work is commonly done from scaffolding under the bridge, requiring the blocking off of one or more lanes of roadway. Very little serious attention had been given to the confinement of the blasted materials and the sprayed paints to the immediate work area. This has resulted in the release of vast quantities of dust containing particles of lead and other toxic materials in the surrounding atmosphere. The particles are fine enough to become airborne, and may travel surprising distances before settling out eventually and contaminating the ground. Some areas around the sites of major projects have become practically inhabitable, resulting in extensive liability to the contractor and/or to the states where the work was authorized and done.

In the painting phase of the project, the difficulty has been the release of airborne paint particles that migrate from the work area out to where automobiles passing in adjacent lanes are exposed to an unwanted application of spotty color. Two or three hundred cars requiring repainting at over two hundred dollars each raises the cost of the project considerably. In the usual bridge project, there may well be five successive painting passes over the structure in sequence, with labor representing about half of the cost. Because of the difficulty in preventing these conditions, insurance protecting the contractor and the State is either unattainable, or available only at prohibitive costs.

Removal of the material cleaned from the bridge presents still another problem. The quantity of it can run to hundreds of tons, and collection of it and delivery to a disposal site is costly. Above a certain point in toxic content, the disposal becomes especially costly. At further increase in the toxic concentration, state law may require special disposal techniques at state expense. Oddly enough, a lead content of sixty-five (65) percent or more will eventually provide a sizeable market value to manufacturers equipped to recycle the material to salvage the lead for reuse. The usual work procedures, however, require additional processing to increase the toxic concentration to the point that the recycle value becomes available.

These problems are present in the maintenance of other structures as well. The surfaces of buildings, ships, and many others requiring similar treatment, will produce similar conditions. The present invention is directed at the confinement of all airborne particles to the immediate work area, and to the complete recovery of all blasted materials so that blasting particles can be recycled and concentrated for disposal or reuse.

SUMMARY OF THE INVENTION

An enclosure including a walkway is suspended from the bridge structure to define a work space including a portion of the bridge being processed. With the usual bridge configuration, the enclosure extends parallel to the principal beams, and work is done on two or more of the adjacent beams at a time. The enclosure is preferably sealed against the next beams, or against the railing of the bridge on the outside. The enclosure is preferably V-shaped in cross section, with the apex at the bottom converging into a vacuum conveyor that carries the particles outside the enclosure and to the separating and collecting equipment. A short floor at the apex is preferably provided with a series of holes fitted with funnels extending into a conduit maintained at a pressure far enough below atmospheric to induce movement of all of the material descending in the enclosure, and passing down through the funnels. The reduced pressure in the enclosure confines all of the airborne particles. The enclosure is preferably provided in separable modules, and is suspended from cables or tracks extending transversely to the beams. They can thus be moved from one bay to another as work proceeds.

DESCRIPTION OF THE PREFERRED EMBODIMENTS

Figure 1:
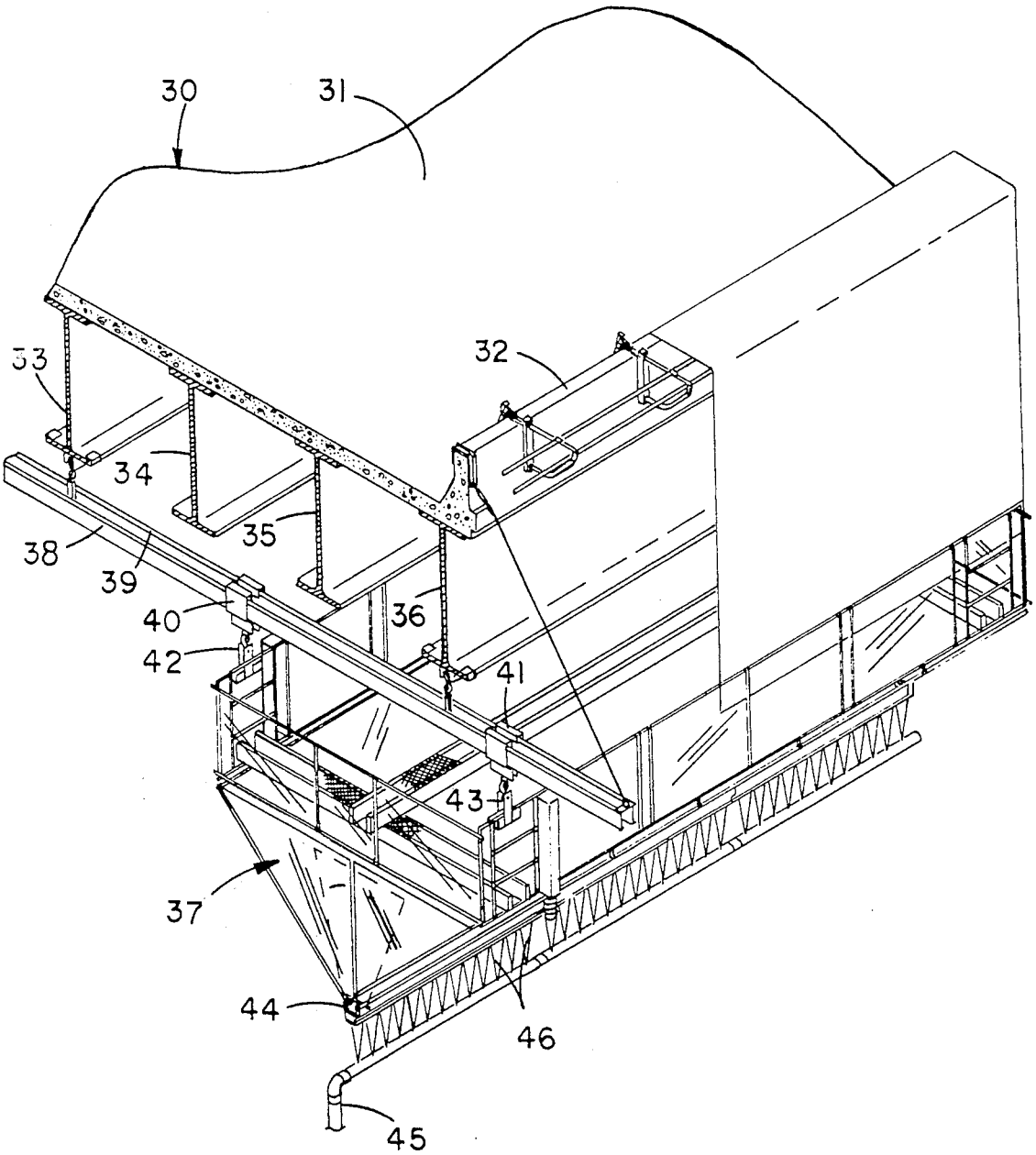
FIG. 1 is a perspective view, partially in section, showing the installation of a work enclosure embodying the present invention, which is positioned for doing work on particular beams of a conventional bridge structure.

Referring to FIG. 1, a conventional bridge is indicated generally at 30, having a concrete roadway 31 and side railing 32 supported by a series of substantially parallel I beams 33–36. The work-enclosure module 37 is shown suspended from the transverse guideway formed by the pair of beams 38–39. Carriages as shown at 40 and 41 are free to move along this track, these being shown in greater detail in FIG. 4. Suspension units as shown at 42 and 43 connect the carriages to the enclosure. This arrangement is provided at both ends of the module 37. Particulate material accumulating within the enclosure moves downward toward the center of the V-shaped configuration to a trough structure 44 forming the apex of the triangular cross section, through which the material flows downward to the vacuum conduit 45 through the funnels 46.

Figure 2:
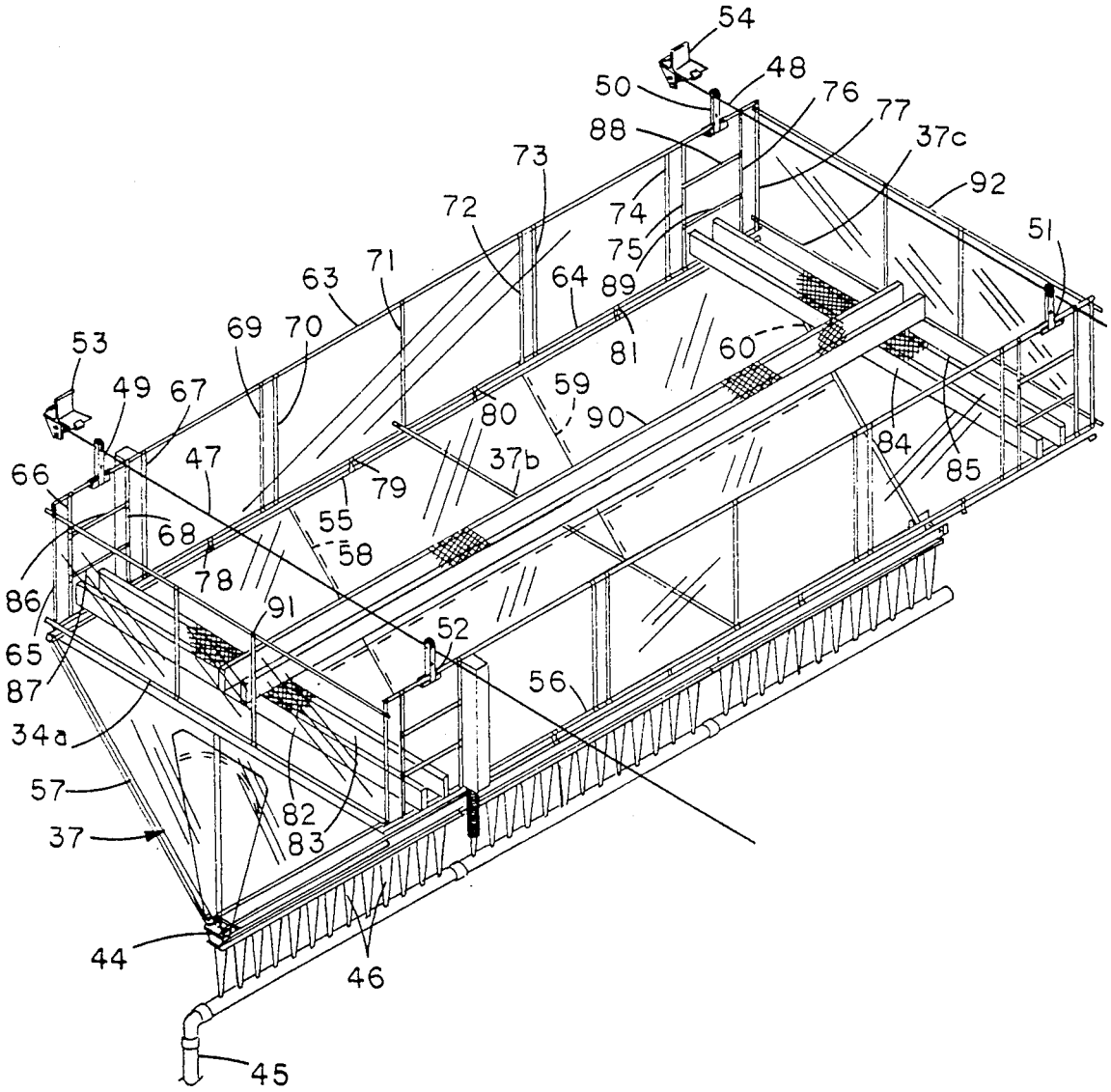
FIG. 2 is a perspective view of the enclosure alone, on a somewhat enlarged scale over that of FIG. 1.

FIG. 2 illustrates the same enclosure as that appearing in FIG. 1, but suspended from the transverse cables 47 and 48 by the smaller carriages 49–52. The cables are secured to bracket terminals as shown at 53 and 54, shown in greater detail in FIG. 11. Each side of the lower V-shaped configuration of the module is formed by a rectangular assembly of aluminum or magnesium tubes including the longitudinals 55 and 56 and the inclined members 57–60. These can either be arranged as shown, or rotated ninety degrees so that the longer dimension forms the incline. The spaces between the rectangular frame members are preferably covered by transparent material available in four foot by eight foot panels, so that the illustrated module would have a length of twelve feet. When re-oriented so that the long dimension occurs along the incline, the module length would be eight feet. The members forming the rectangular frame are preferably interconnected by conventional tubing junction fittings of the type shown at 61 and 62 in FIG. 5, and usually associated with hand rails, scaffolding, and other tubular structures. These rectangular frames are made up in considerable numbers in advance, and are identical on the opposite sides of the enclosure.

Smaller rectangular frames extend vertically from the upper edges of the V configuration, and these are also identical on the opposite sides. Longitudinals as shown at 63 and 64 are interconnected by verticals 65–77. The lower longitudinal 64 is coupled to the longitudinal 55 of the lower frame by standard fittings at the positions indicated at 78–81, and at other locations wherever they appear desirable. It is usually desirable to incorporate cross members as shown at 37*a–c* to preserve the spacing across the top of the converging section. These can be of adjustable length to accommodate various bridge beam spacing, as discussed later in connection with the end closure. The cross members may be a part of the lower converging sections, or of the upper vertical sections.

Figure 8:
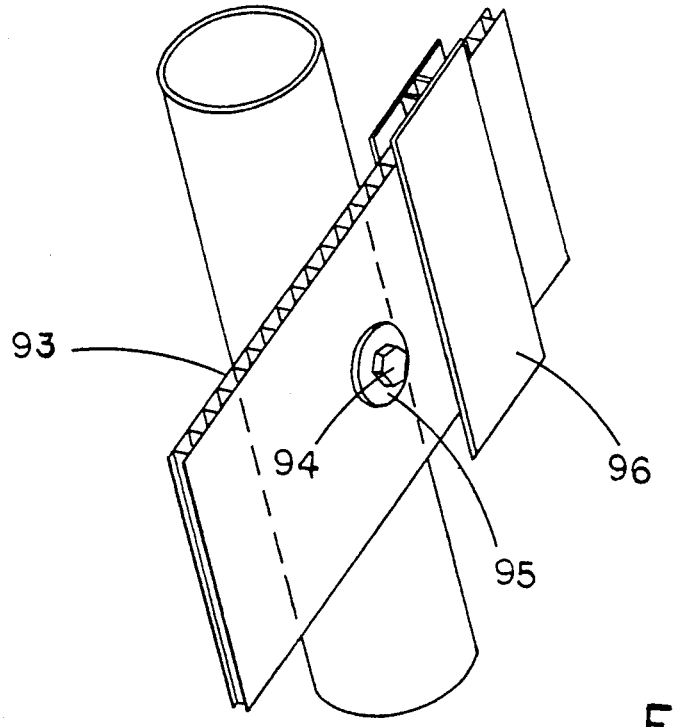
FIG. 8 is a perspective view showing the attachment of the enclosure panels to the enclosure frame.

Transverse walkways are formed by the pairs of beams 82–83 and 84–85, which are preferably bridged by steel mesh shown in fragments in FIG. 2. These pairs of beams rest at their opposite ends, either on the lower longitudinals 64, or on the rungs 86–89 of the ladder-like configurations at the opposite ends of the vertical section of the enclosure. This degree of vertical adjustability permits the optimum level of the longitudinal walkway 90 formed by a similar pair of beams resting on the transverse walkways. The longitudinal guideway 90 is readily adjustable to positions between the opposite sides of the enclosure. End frames as indicated at 91 and 92 extend between the vertical sides to complete the vertical portion of the enclosure. All of these rectangular frames are covered by preferably transparent or translucent sheets indicated at 93 in FIG. 8 secured to the frame members 99 by bolts as shown at 94 and washers 95, with the bolts traversing the panels 93 and engaging tapped holes in the walls of the frame members. The panels 93 are standard, and are formed by spaced surface sheets interconnected by webs that provide a very significant rigidity and lightness to these panels. The ends of the panels are interconnected by the H-shaped strips 96.

Figure 18:
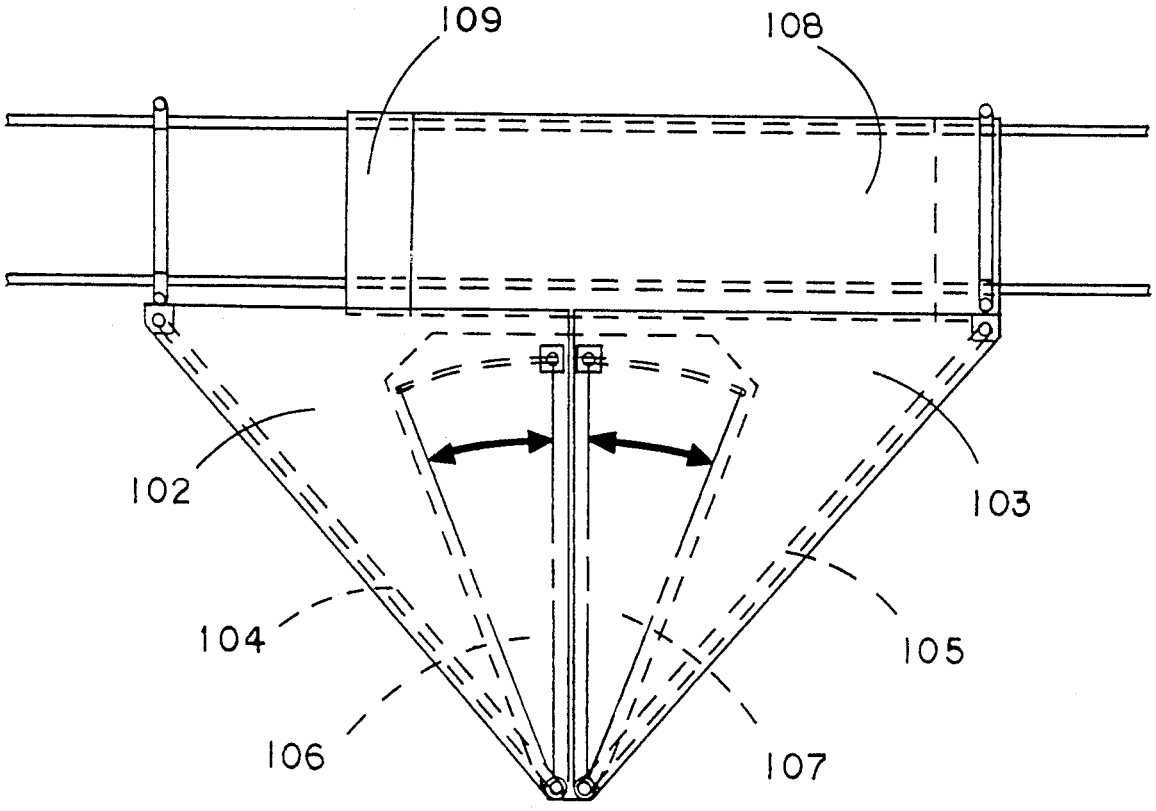
FIG. 18 is an end view of the preferred end closure for the assembled group of modules extending between the beam-supporting piers of the bridge.
Figure 19:
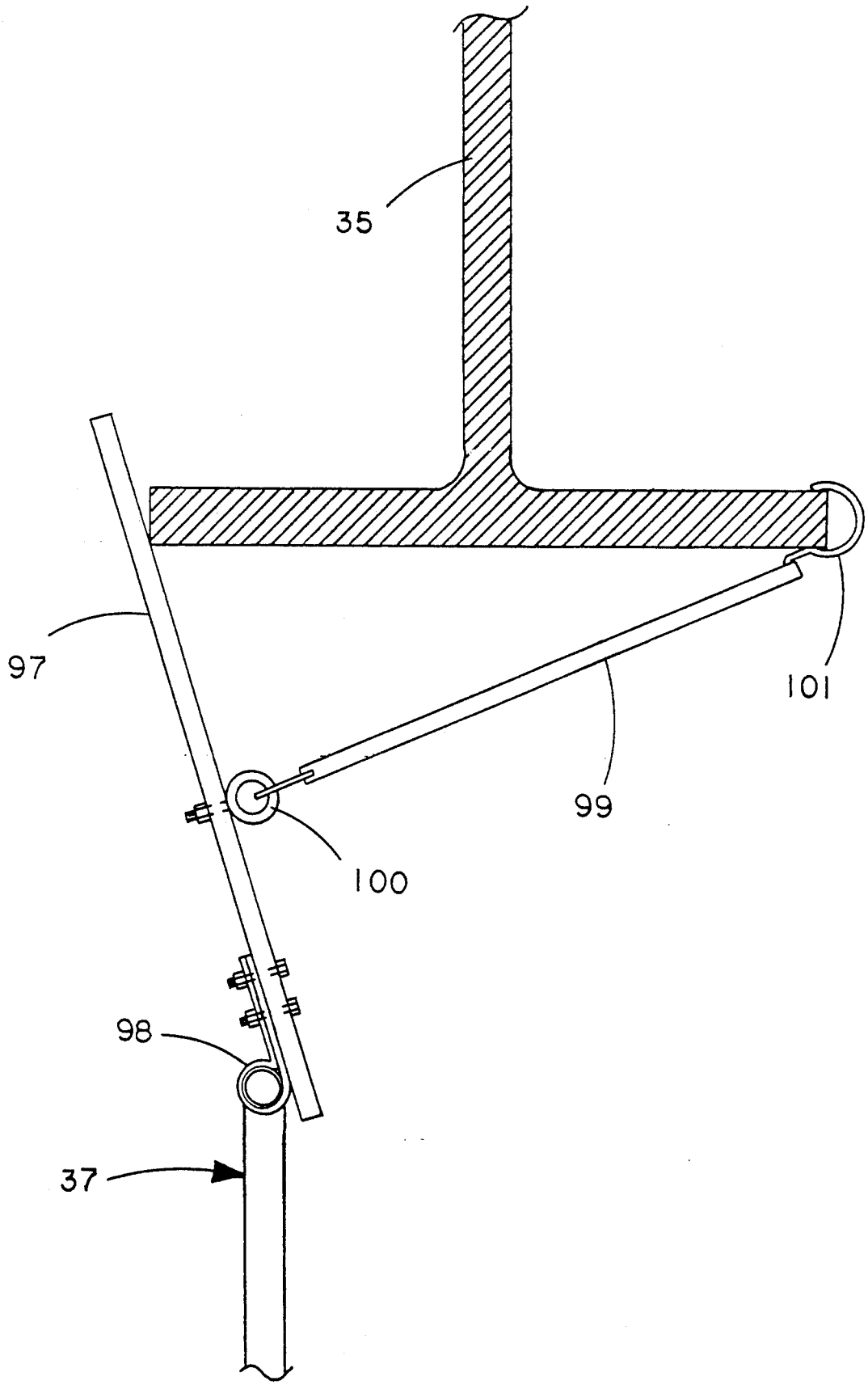
FIG. 19 is a view on an enlarged scale showing the preferred system for sealing the top of the enclosure to the beams.

Preferably, the upper periphery of the enclosure is sealed against the beams on the sides by the flaps 97 shown in FIG. 19 pivotally connected to the upper longitudinals 63 as shown at 98. These flaps are urged towards the edges of the bridge beams by an elastic strap 99 extending from the eye bolt 100 on the flap to the hook 101 engaged over the edge of the beam flange. It is also preferable that the space between the beams be blocked off by a custom-fitted panel of plywood or some other such material (not shown) which will extend for the full height of the beams. Flaps as shown in FIG. 19 may also be applied across the ends of the enclosure to bear against the custom panels, either urged against the panels by biasing action, or by establishing significant resistance to rotation in the hinge connection at 98. The end closure of the lower converging portion of the modules is illustrated in FIG. 18. Triangular panels as shown at 102 and 103 are secured to the inclined frame members 104 and 105, and these have overlapping portions as shown at 106 and 107. The upper end portions of the enclosure are also provided with panels as shown at 108 and 109, which are overlapped. These are secured respectively to the opposite sides of the frame of the enclosure. The reason for this arrangement is in the fact that the spacing of bridge beams is by no means uniform, so the enclosure is preferably adaptable to a variety of beam spacings. As the upper portions of the convergence are accommodated to different beam spacing, the end panels can accept this variation in distance without affecting the completeness of the enclosure.

Access for personnel into the interior of the enclosure after it has been placed in position can be over the ends of the upper sections, prior to the installation of the custom-fitted panels between the beams. Sand blasting hoses and lines associated with spray painting can be led into the enclosure through appropriate openings in the lower end sections, or these can also be admitted over the ends of the upper sections.

Figure 13:
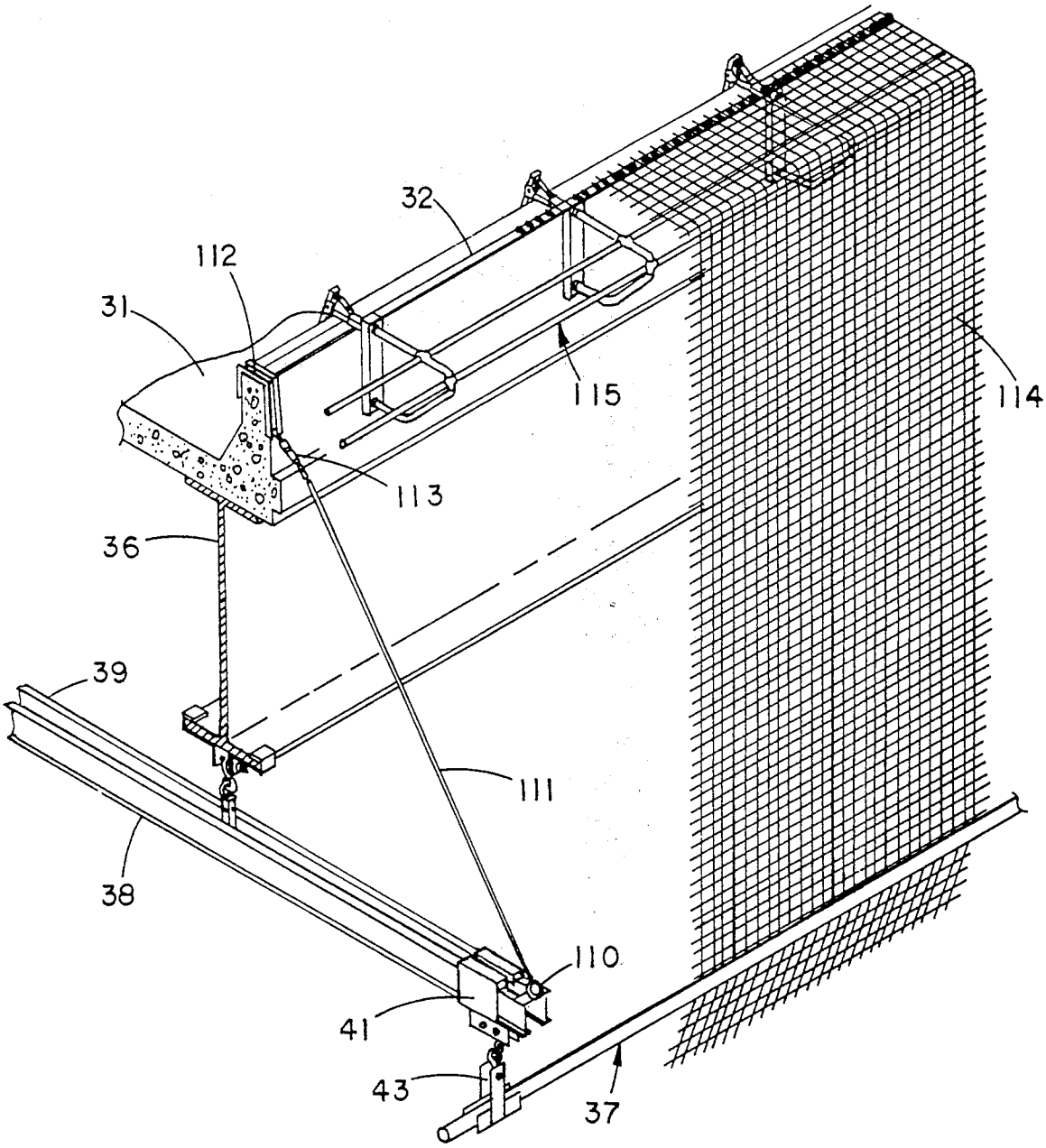
FIG. 13 is a perspective view showing the configuration of the enclosure on the outside of the bridge, providing a work space for the processing of the outer surfaces of the bridge beam.
Figure 16:
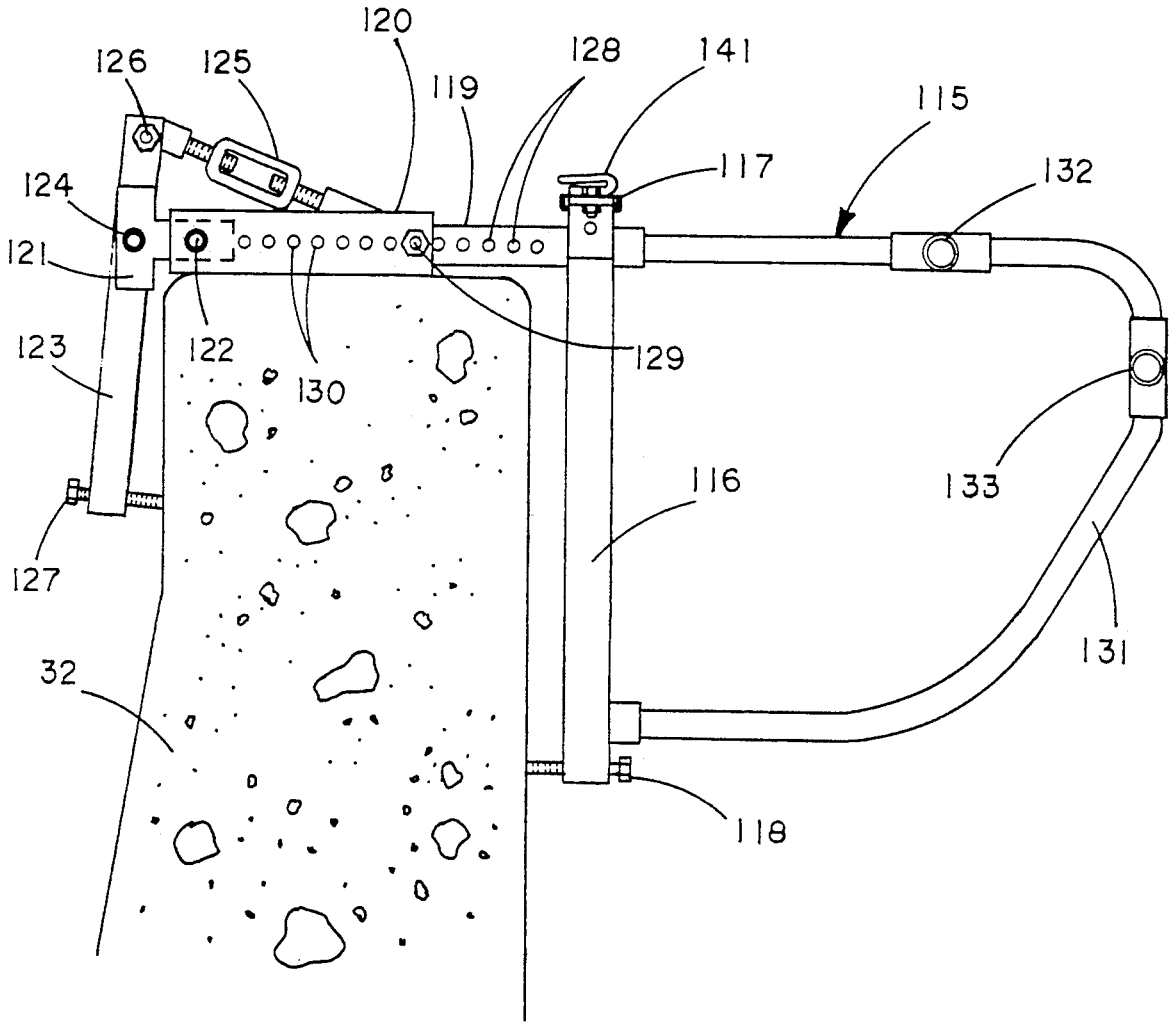
FIG. 16 is an end view of the bracket engaging the top of the bridge rail for supporting the outer enclosure illustrated in FIG. 13.
Figure 20:
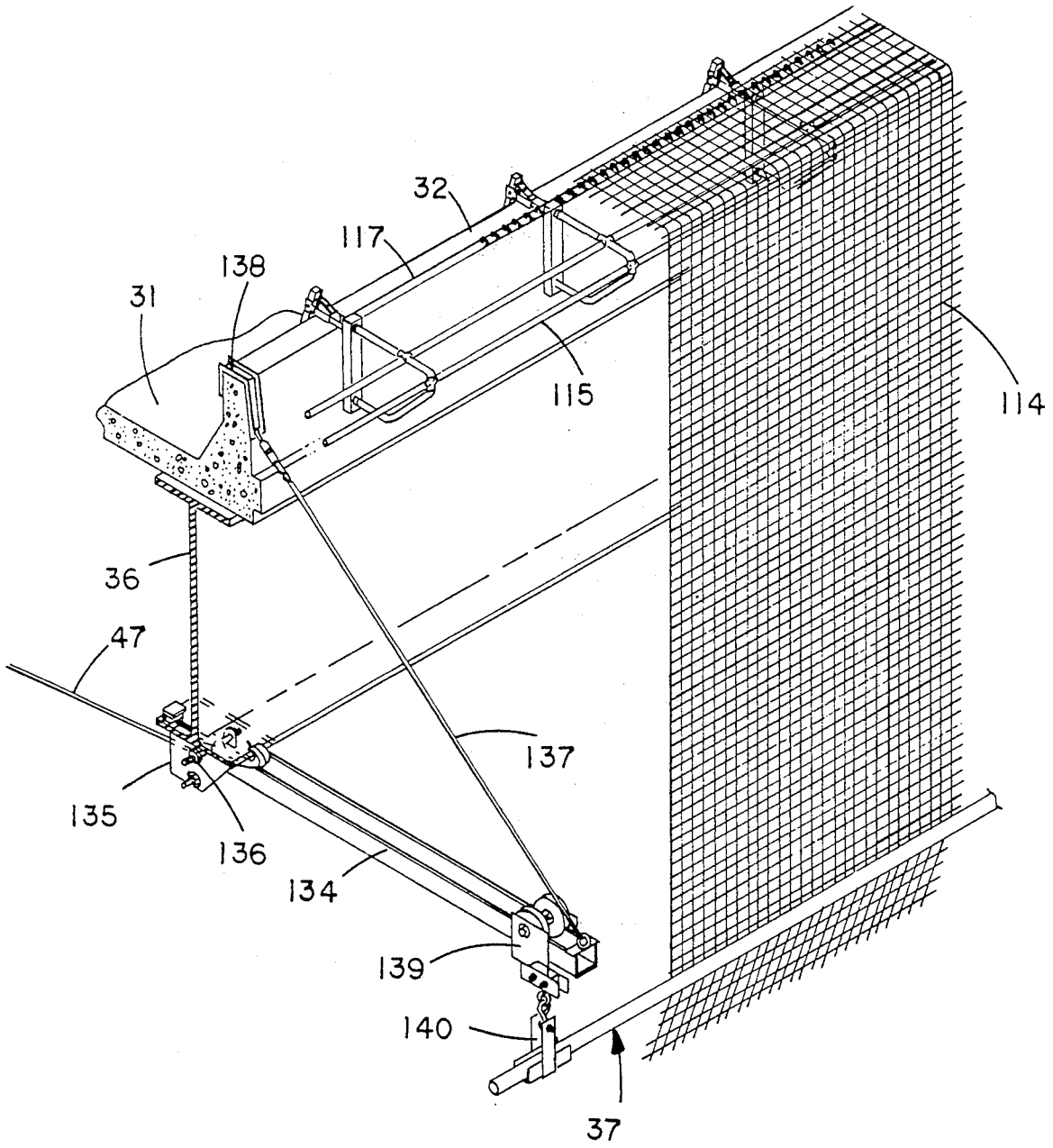
FIG. 20 is a perspective view of the outer support system used with cable guideways.

Provision of a sheltered access to the outer surface of the outermost beams can be provided with the arrangements shown in FIGS. 13 and 20. Where the transverse guideway is in the form of paired beams, as shown in FIG. 1, the carriages 41 are simply permitted to run out to the end, where the bracket 110 forms a terminal for the connection of the diagonal cable 111. This cable extends to the C clip 112 embracing the upper edge of the bridge railing 32. Preferably, the turnbuckle 113 is included for purposes of adjustment. A sheet of open metal mesh 114 extends from the top most side rail of the enclosure up to a support frame which is also hung from the bridge railing 32. The preferred construction of this frame is best shown in FIG. 16. A series of vertical beams 116 are interconnected by the hook rail 117. An adjustable bearing bolt 118 is mounted at the lower extremity of the beams 116, and the horizontal beam 119 is welded to the beams 116 in the illustrated position. The horizontal beam 119 is in telescoping relationship with the outer beam section 120, to which a pivot bracket 121 is secured at the bolt 122. A lever 123 is pivotally connected to the bracket 121 at the bolt 124. The opposite end of the lever 123 is pivotally connected to the turnbuckle 125 at the bolt 126. The adjustment provided by the turnbuckle 125, and by the adjustable bearing bolt 127 provides a clamping action capable of embracing a wide range of bridge railing structures. This range is augmented by the provision of a number of holes shown at 128, which can be engaged by the bolt 129 traversing both the horizontal beam 119 and the outer beam 120. The outer beam may also have a similar series of holes as shown at 130 for the engagement of the bolt 129, or a different bolt forming the terminal for the turnbuckle 125.

The outer portion of the frame 115 is formed by a series of generally U-shaped arches 131 secured at the ends to the vertical beams 116. The arches are interconnected by the longitudinals 132 and 133, which form the support for the mesh sheet 114. A layer of transparent film (not shown) is normally draped over the mesh 114 to form the enclosure for this part of the assembly.

Figure 17:
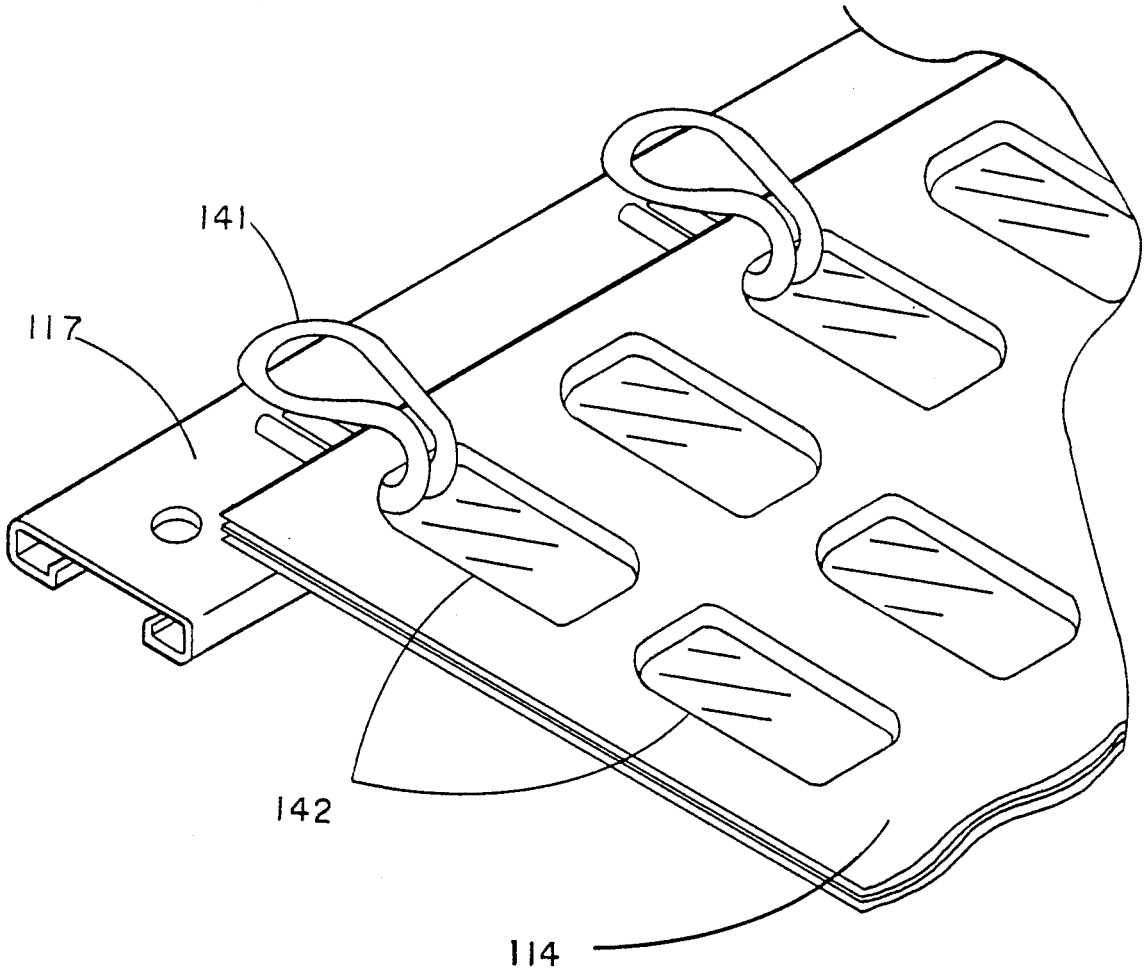
FIG. 17 is a perspective view on an enlarged scale showing the attachment of the film-supporting mesh to the bracket illustrated in FIG. 16.

FIG. 20 illustrates the arrangement for providing the exterior shelter where the transverse guideway is a cable, as shown in FIG. 2. An extension beam 134 is bolted to the cable terminal bracket 135 at 136. A diagonal cable 137 extends from the outer extremity of the extension beam 134 to the C clip 138 embracing the bridge rail 132. A carriage 139 is capable of moving along the beam 134, and carries the shelter assembly through the suspension bracket 140. As the enclosure is moved from the position shown in FIG. 20, where work is done on the outside surface of the beam 36 to the left where work can be continued on the inside bays, or vice versa, it becomes necessary to transfer the weight of the enclosure from the carriages 34 over to the carriages 52 shown in FIG. 2. This can be done by rigging some form of temporary lashing or clip to the lower beam flange as the bracket 140 is disconnected, and then reconnected to the cable carriage. In the arrangement shown in both FIG. 13 and FIG. 20, the primary function of the exterior assembly is to support the mesh sheet 114, which in turn provides the support for the closure film. FIG. 17 illustrates the preferred arrangement for connecting the mesh sheet 114 to the hook rail 117. A series of hooks 141 in the illustrated configuration are welded to the hook rail 117. The hooks 141 are of a width such that they can be admitted through the openings 142 in the mesh sheet 114, forming a secure attachment that can be readily disconnected.

Figure 3:
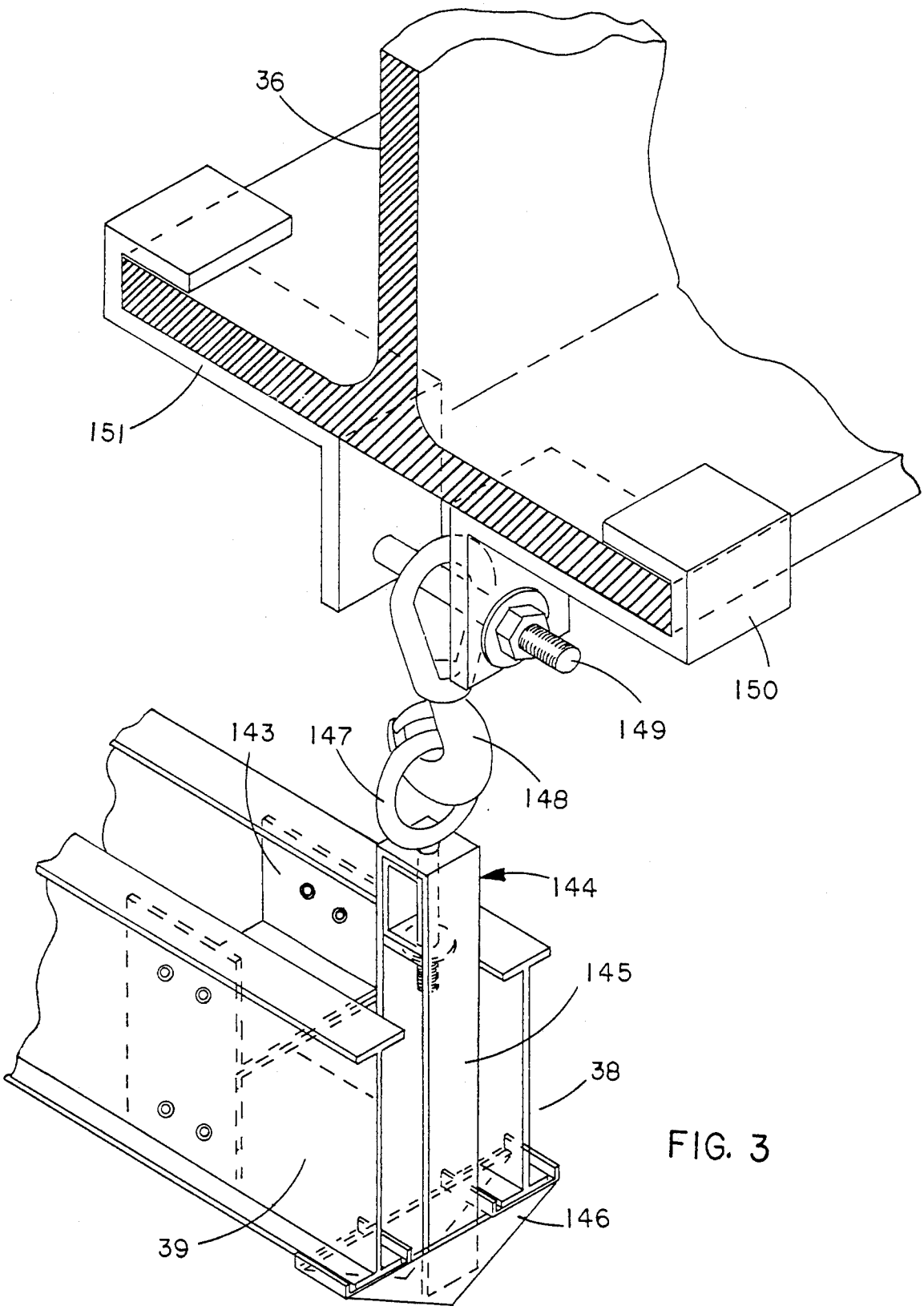
FIG. 3 is a perspective view on an enlarged scale showing the suspension of the transverse track from the bridge structure.
Figure 4:
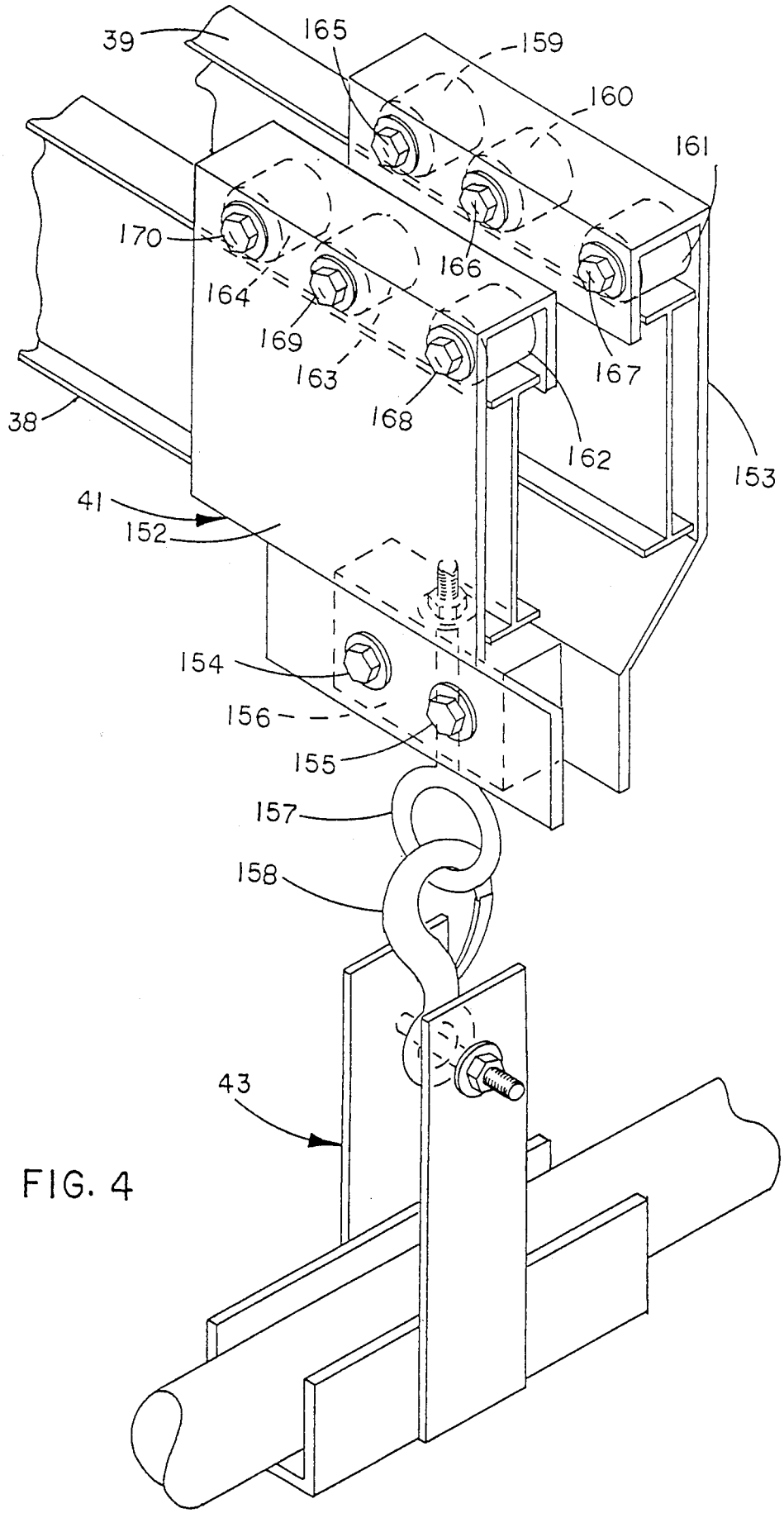
FIG. 4 is a perspective view showing the carriage riding on the transverse track, and the manner of suspension of the enclosure from the carriage.

Some of the hardware details of the enclosure are shown in FIGS. 3 and 4. The suspension of a double beam track shown in FIG. 1 is illustrated in FIG. 3. The track beams 38 and 39 are connected together by the H-shaped spacer 143, preferably by bolts for purposes of dis-assembly. The spacer 143 establishes a spaced relationship between the beams 38 and 39, and the T-shaped suspension bracket 144 has the vertical section 145 extending downward between the beams 38 and 39, and terminating in the horizontal section 146 which supports the track beams. The eye bolt 147 transfers the weight from the T bracket to the safety hook 148 connecting to the clamping bolt 149 traversing the clips 150 and 151 engaging the opposite edges of the lower flange of the beam 36. In FIG. 4, the carriage 41 riding on the track beams 38 and 39 includes the side plates 152 and 153 secured together with bolts 154 and 155 against a spacer 156. The vertical eye bolt 157 traverses the spacer, and receives the safety hook 158 of the suspension bracket 43. The upper extremities of the plates 152 and 153 are bent into an inverted U configuration providing spaced flanges accommodating the rollers 159–164 carried on the bolts 165–170. These rollers ride along the top flanges of the beams 38 and 39.

Figure 11:
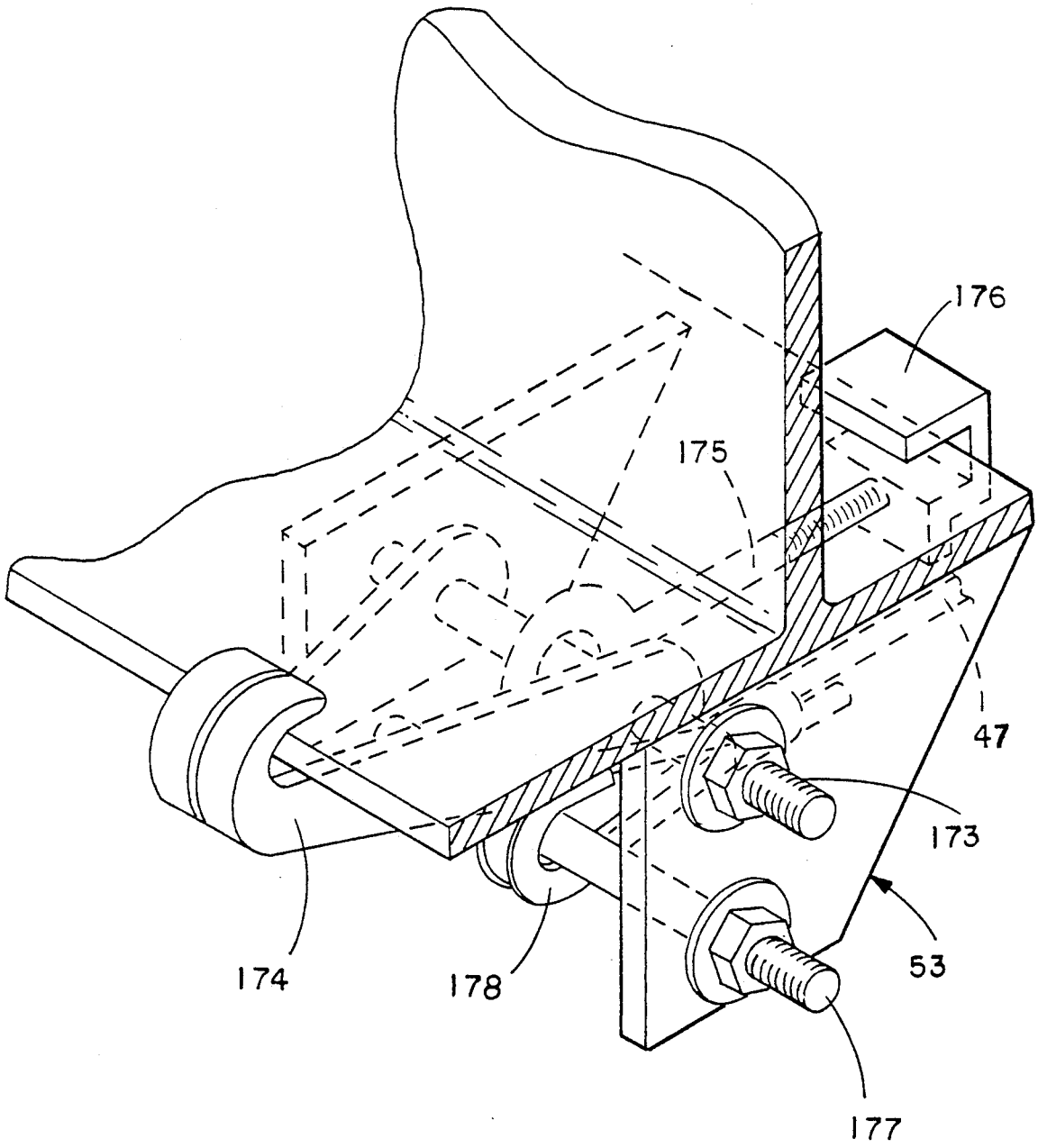
FIG. 11 is a perspective view showing the cable-terminal bracket connecting the transverse guideway cable to one of the bridge beams.
Figure 12:
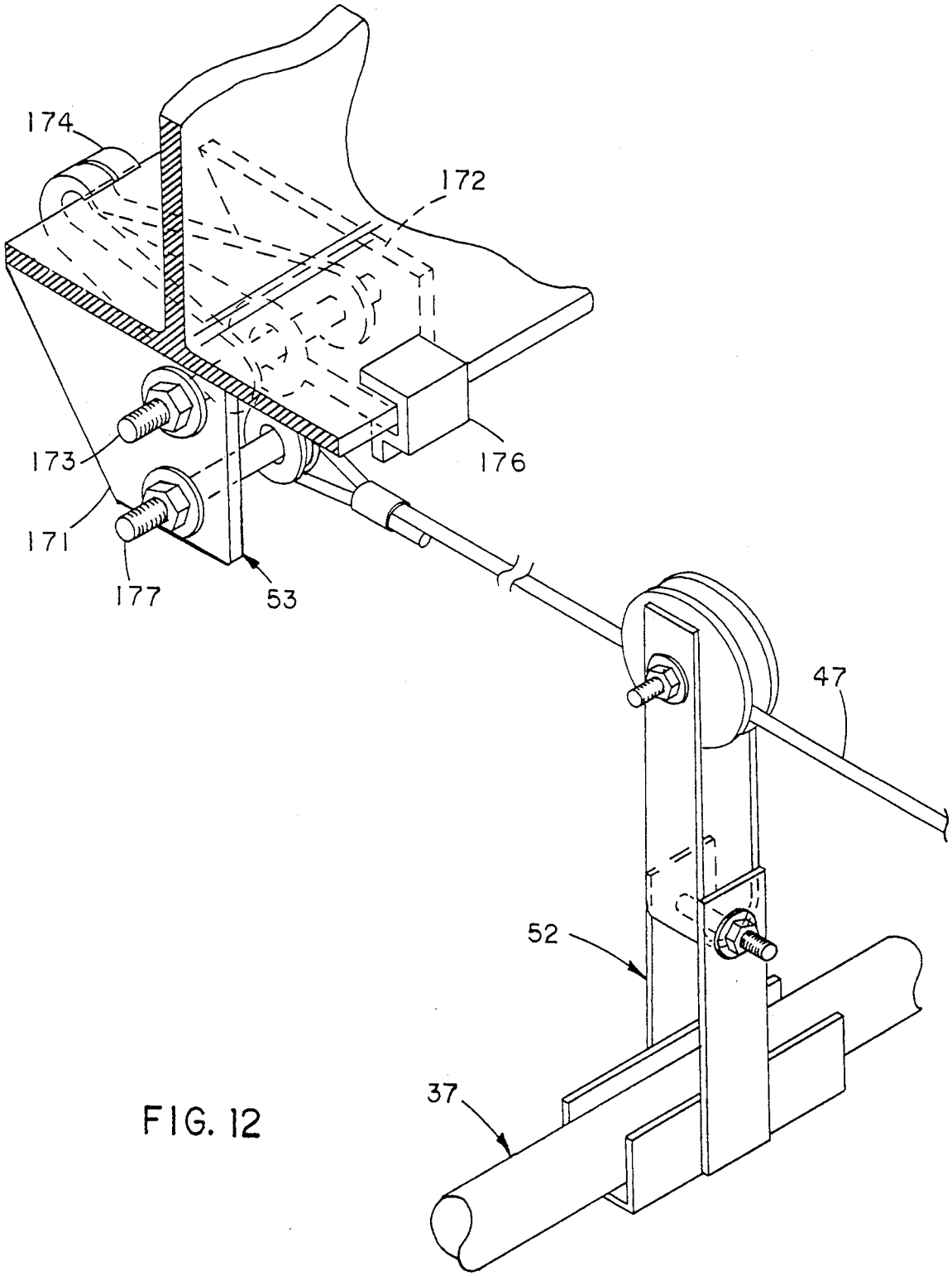
FIG. 12 is a perspective view showing the type of carriage supporting the enclosure when the transverse cable is used as a guideway.

FIGS. 11 and 12 show the system for anchoring the transverse cable guideways. These terminal arrangements must be very sturdy, as it is preferable to maintain a tension in the transverse cables of between two and three thousand pounds, to avoid excessive sag. Brackets 53 have spaced side plates 171 and 172, and are interconnected by the bolt 173 forming the pivot connection for the hook 174 engaging the edge of the beam flange. An eye bolt 175 extends from this bolt to the clip 176, and tightening of the eye bolt firmly grips the I beam flange between the hook and the clip. A lower bolt 177 engages the spliced eye 178 of the cable 47 to form the terminal connection.

Figure 5:
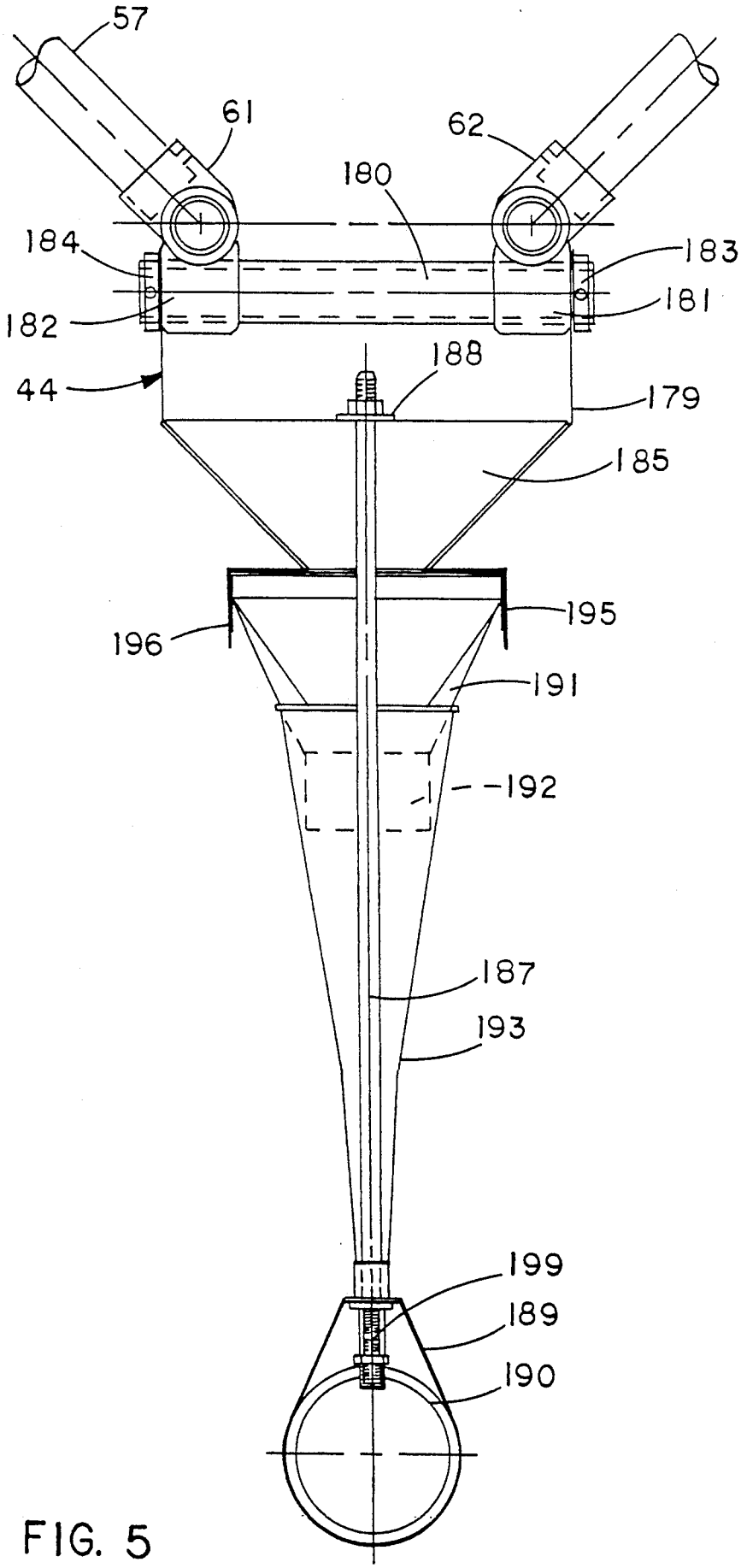
FIG. 5 is an end view on an enlarged scale showing the collector-conveyor system of each enclosure module.
Figure 7:
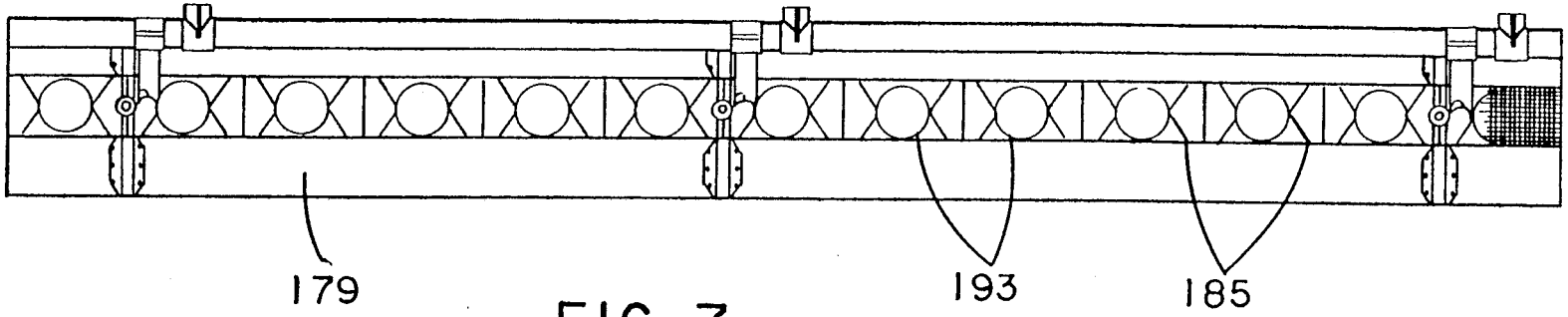
FIG. 7 is a top view with respect to FIG. 6.
Figure 6:
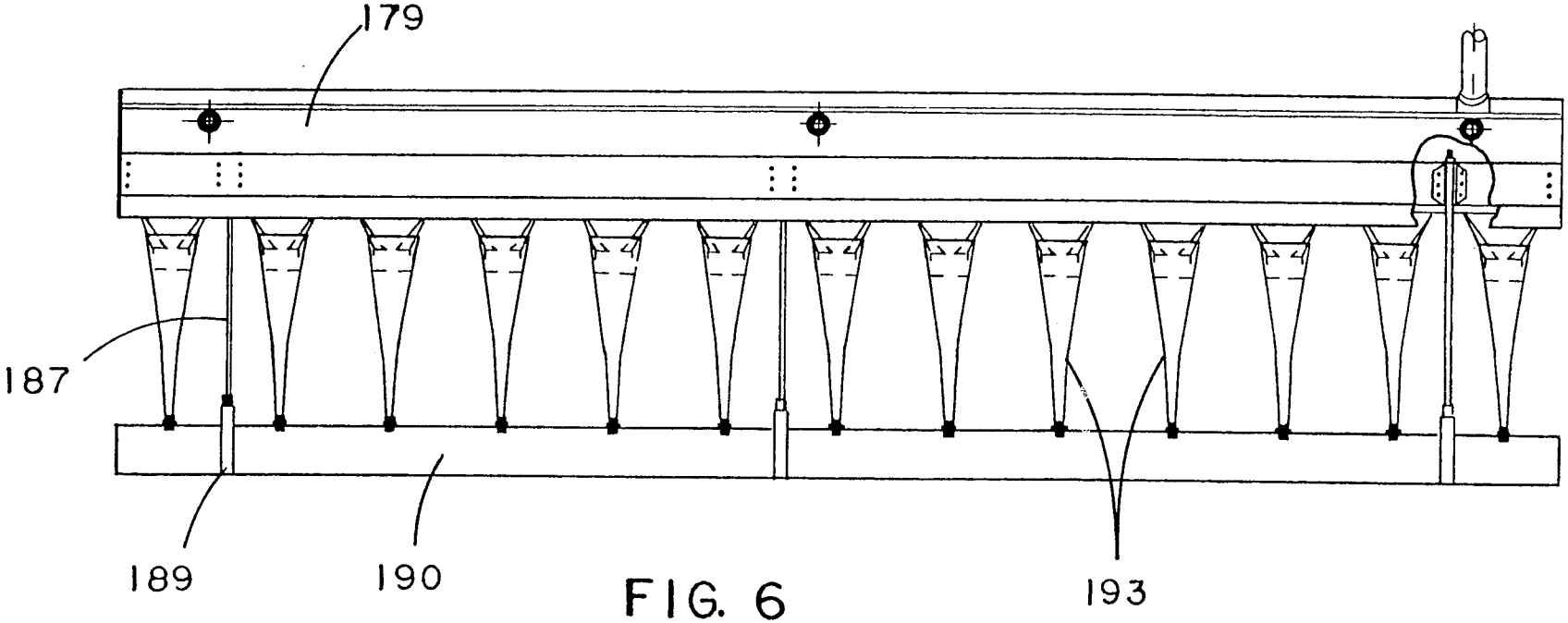
FIG. 6 is a side elevation of the collector-conveyor.
Figure 9:
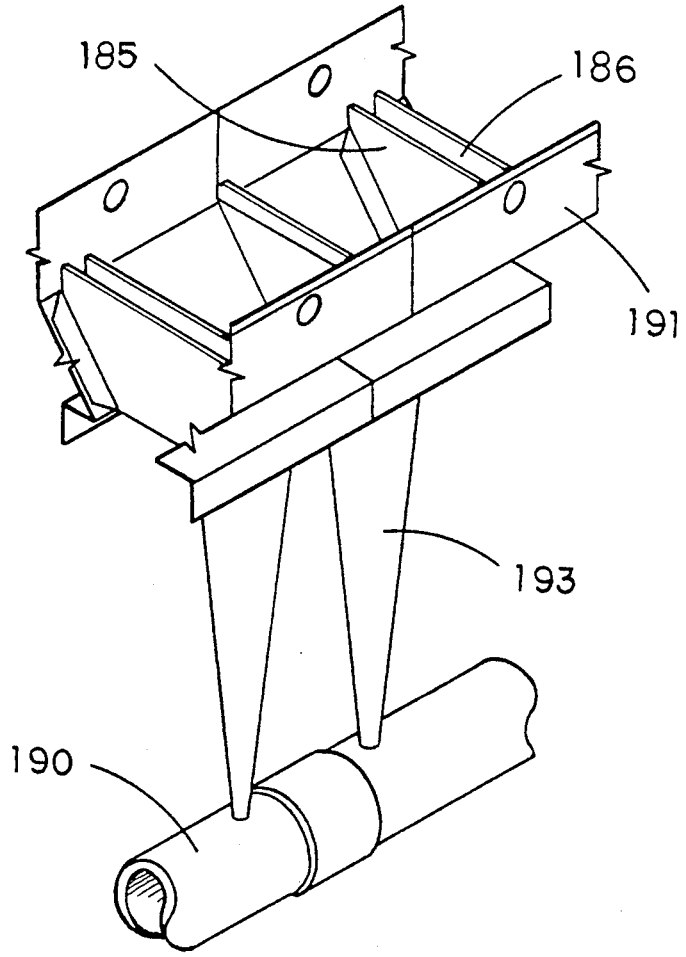
FIG. 9 is a fragmentary perspective view showing the structure of the collector-conveyor.
Figure 10:
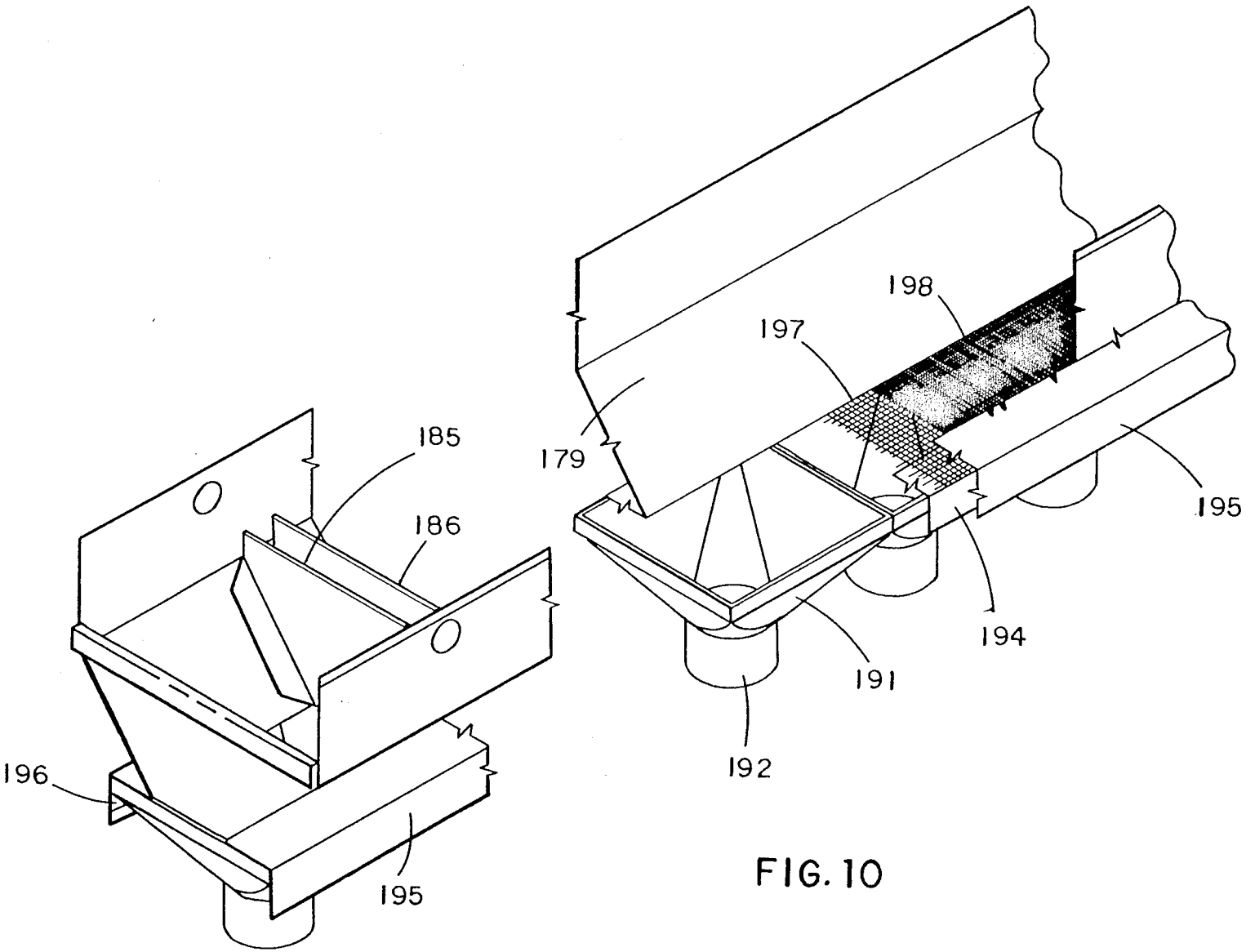
FIG. 10 is a fragmentary view showing the structural details of the collecting trough, on a somewhat enlarged scale.

The entire structure thus far described has the function of confining the particulate material within the enclosure to where it can move downwardly under the force of gravity along the inclined sides of the enclosure to the collector-conveyor system shown in FIGS. 5–7, and 9–10. Referring to FIG. 5, the trough 179 extends along the lower extremity of the enclosure module, receiving all of the material that falls and slides downward along the inclines of the V configuration. The trough is secured to the frame of the enclosure at the short transverse tubes 180, the ends of which traverse holes in the side walls of the trough 179. The short tubes 180 are connected to the frame work of the enclosure by the standard tube junction fittings 181 and 182. The material of the trough 179 is of comparatively light sheet metal, permitting it to be sprung open to where it can snap over the protruding ends of the tube 180, and held in place by the retaining rings 183 and 184. At regularly spaced positions along the trough, pairs of transverse webs 185 and 186 are secured to the trough. Between these webs, long vertical bolts 187 extend from the washers 188 bridging across between these webs, and downward to engage the suspension straps 189 embracing the vacuum conduit 190. This conduit is preferably in sections joined by couplings as shown in FIG. 9. A group of adaptors indicated at 191 (see FIG. 10) form the bottom of the trough 185, and convert an initially square opening to a round outlet 192 fitting into the top of the funnels 193. An angular side rail preferably extends along both sides of the row of adaptors, and these are embraced by the side flanges 195 and 196 of the trough 179. A heavy wire mesh 197 is laid across the top of this assembly for support of the finer screen 198, as best shown in FIG. 10. The bolts 187 hold this entire assembly in position.

The lower extremities of the funnels 193 engage the nipples 199 communicating with the interior of the vacuum conduit 190. Maintenance of a reduced air pressure within the conduit 190 has the effect of sucking the particulate material down through the funnels, where the relatively high velocity vacuum flow entrains the particles and carries them to a standard separator (not shown). The inside diameter of the conduit 190 can be on the order of four inches, and it has been found that a reduction of atmospheric pressure of approximately five inches of mercury will be sufficient to induce a sufficiently great velocity in the conduit to fully entrain the particles and keep the conduit clear. The upstream end of the conduit is preferably left open. This has the additional desirable effect of tending to pull the particles down through the funnels, and avoid any buildup of material along the walls of the funnels or in the trough. The screens are provided to entrap any material which might be of sufficient size to jam the funnels. This continued application of suction also has the desirable effect of maintaining a slightly reduce pressure within the enclosure, resulting in the confinement of particulate and sprayed material, and the continued removal of it from the work area.

Figure 14:
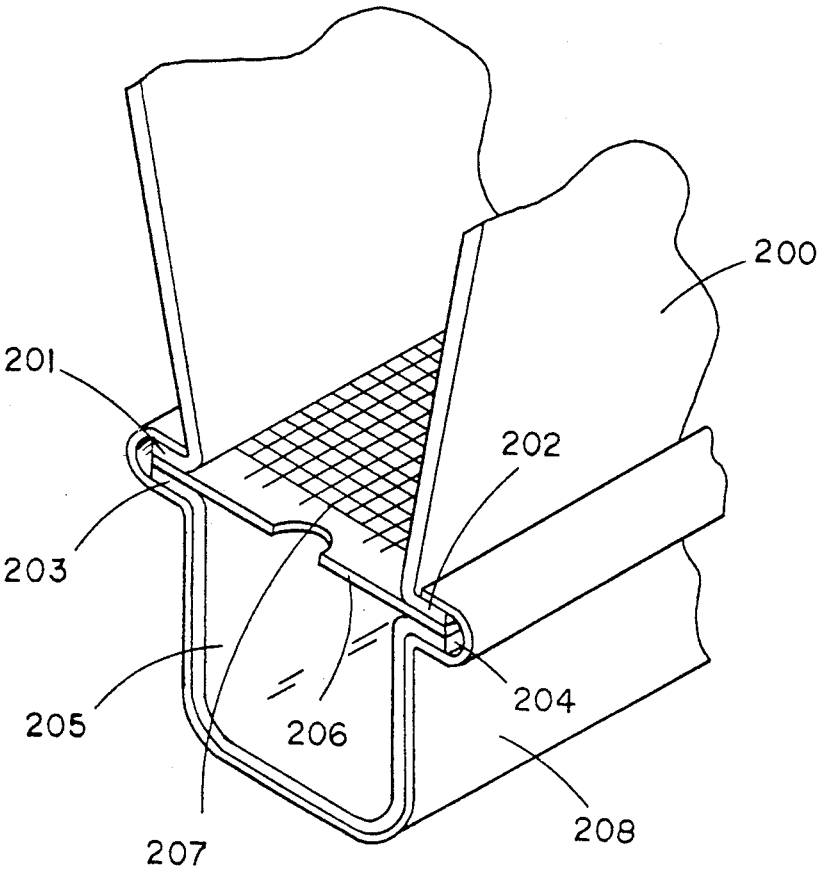
FIG. 14 is an end view of a module embodying a modified form of the invention with respect to the collector-conveyor.
Figure 15:
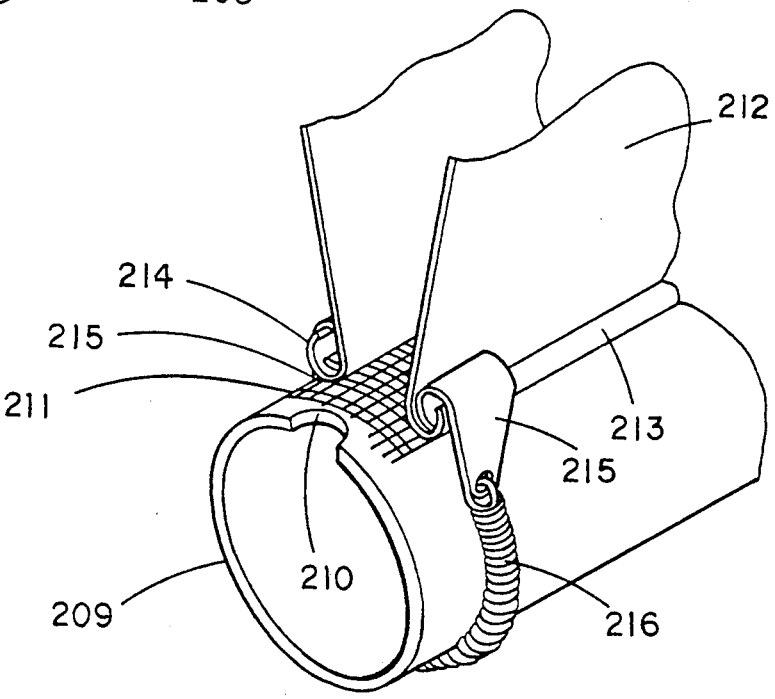
FIG. 15 illustrates a further modification of the invention with respect to the collector-conveyor.

FIGS. 14 and 15 show modified forms of the invention with regard to the construction of the vacuum conduit. In FIG. 14, the trough 200 terminates in the out-turned flanges 201 an 202. Similar out-turned flanges 203 and 204 of a channel 205 receive the aperture plate 206 sandwiched between the pairs of flanges. Preferably, the screen 207 is laid on top of the aperture plate 206, and the entire assembly is held together by the clips 208 embracing the pairs of flanges at the opposite sides of the assembly. In the FIG. 15 modification, the tubular conduit 209 is provided with holes as shown at 210, which are covered by a strip of screen 211. The opposite sides of the bottom of the trough 212 are curled as shown at 213 and 214 to form receptacles for the clips 215 interconnected by the tension spring 216, which holds the assembly together.

When the enclosure is used in either the blasting or the spray painting phases of the maintenance process, it is preferable to use a conventional ventilation system (not shown) communicating with the interior of the enclosure to draw off the airborne fumes and paint or blasted particles. This is recommended for the safety of the working personnel, both as a fire or explosion prevention, and for the control of pollution.

I claim:

1. A method of removing and then applying surface material on structural components, comprising:

supporting an enclosure adjacent certain of said components to include a surface of at least one of said components in an at least partially enclosed space;

suspending walkway means in said enclosed space, and processing said surface from said walkway means; and establishing a conveyor conduit at the lower extremity of said enclosure, and applying a vacuum to said conduit to remove gaseous and particulate material from said enclosure and maintain reduced pressure within said enclosure.

2. A method as defined in claim 1, wherein said enclosure has a V-shaped cross-section, with the apex thereof below said components, the upper extremities of said V-shaped cross-section being temporarily secured to the lower extremities of selected of said components.

3. A method as defined in claim 1, additionally including suspending said enclosure from guideway means extending below a plurality of said components, said enclosure being moveable along said guideway means to positions wherein surfaces of successive components are enclosable.

4. A method as defined in claim 1, wherein said processing includes particles blasting, and additionally including separating said particles from the material accumulated in said enclosure.

5. A method as defined in claim 4, wherein said particles are substantially round steel shot.

6. A method as defined in claim 1, additionally including sealing the upper extremity of said enclosure to said components.

7. A method as defined in claim 1, wherein certain of said components form spaced walls defining surfaces of said enclosure.

* * * * *